United States Patent [19]

Hebert

[11] 4,023,808

[45] May 17, 1977

[54] RESILIENT FORCE RESISTOR TYPE EXERCISING DEVICE

[76] Inventor: Dalton P. Hebert, 1210 66th St., North, St. Petersburg, Fla. 33710

[22] Filed: Jan. 12, 1976

[21] Appl. No.: 648,561

[52] U.S. Cl. ..... 272/137; 272/143; 272/142

[51] Int. Cl.[2] ..... A63B 21/02

[58] Field of Search ..... 272/142, 135, 136, 137, 272/138, 143

[56] References Cited

UNITED STATES PATENTS

| | | | |
|---|---|---|---|
| 1,749,544 | 3/1930 | Pagano | 272/137 |
| 2,590,951 | 4/1952 | Farison | 272/142 |
| 3,747,593 | 7/1973 | Taylor | 272/142 |
| 3,785,645 | 1/1974 | Yosef | 272/137 |
| 3,807,730 | 4/1974 | Dalton et al. | 272/142 X |

FOREIGN PATENTS OR APPLICATIONS

| | | | |
|---|---|---|---|
| 473,909 | 3/1929 | Germany | 272/142 |
| 442,378 | 2/1936 | United Kingdom | 272/82 |

*Primary Examiner*—Richard J. Apley
*Assistant Examiner*—William R. Browne
*Attorney, Agent, or Firm*—Duckworth, Hobby, Orman, Allen & Pettis

[57] ABSTRACT

An exercise device including at least one and preferably two resistance elements specifically configured for attachment to a pair of spaced apart handle elements. The resistance elements are made from an elastic material so as to provide proper biasing force from the handle elements of the exercise device when they are separated a predetermined distance. Resistance connector structure is integrally formed in each of the handle elements and specifically disposed and configured to be attached to predetermined portions of the resistance elements. The resistance elements are connected together by an interconnecting member. Separation of the handle elements cause the resistance elements to exert a force on the handle elements and the interconnecting member.

6 Claims, 9 Drawing Figures

FIG. 1
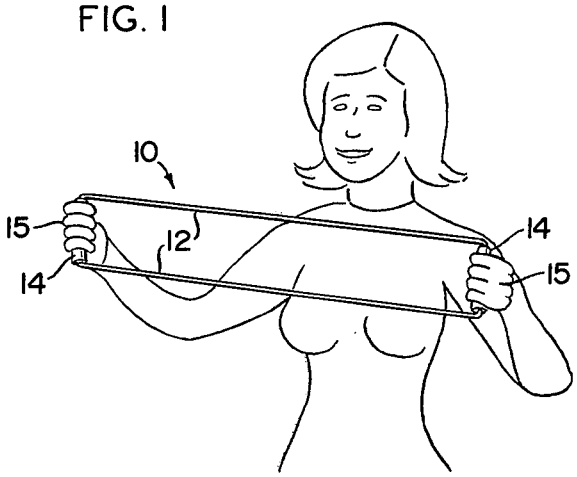
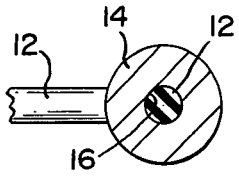
FIG. 4
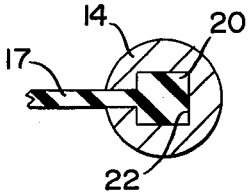
FIG. 9
FIG. 2
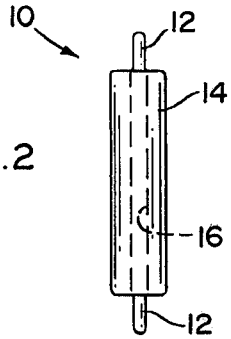
FIG. 3
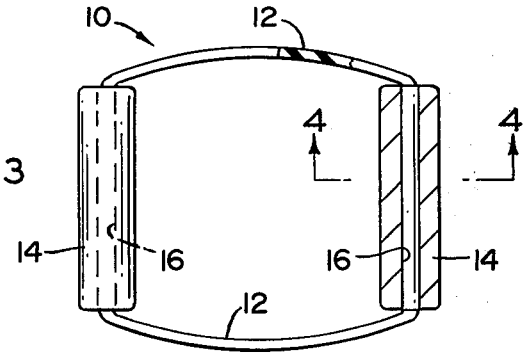
FIG. 5
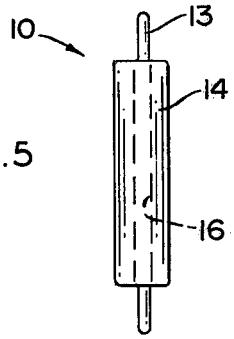
FIG. 6
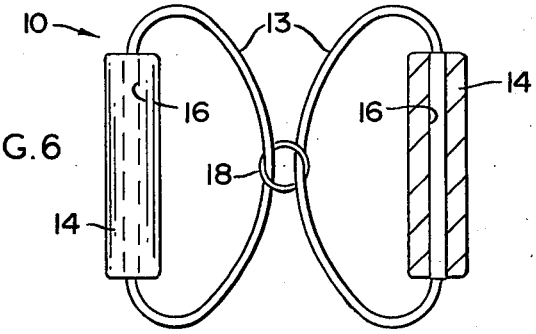
FIG. 7
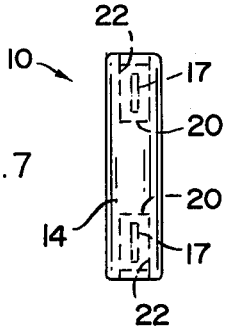
FIG. 8
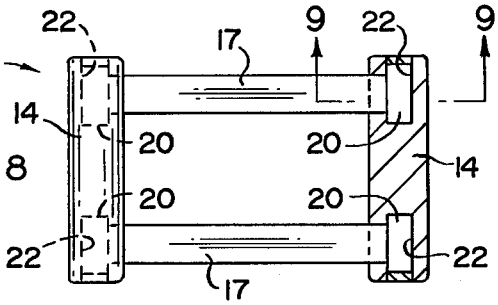

RESILIENT FORCE RESISTOR TYPE EXERCISING DEVICE

BACKGROUND OF THE INVENTION

1. Field of the Invention

This invention relates to an exercise device primarily designed for the development of the pectoral or bust region of the user wherein the device properly manipulates in a predetermined fashion causing forces to be exerted against the intended muscle of the user of the device and thereby develop these muscles.

2. Description of the Prior Art

Since literally the beginning of civilized society, man has been constantly occupied with the development of the physical condition of his body. Such development has been directed not only to the increasing of athletic prowess but also the general conditioning for both well being and cosmetic purposes.

Along with the concentration on physical well being and body development, there has developed a line of exercising devices which normally are designed to develop certain portions or muscles in the human body. Such devices include a wide variety of structural designs and features and are well represented in the patented arts.

A number of the U.S. patents which disclose various exercise devices or similar structure in the prior art are set forth hereinafter.

The structures disclosed in these patents are represented as set forth above: Pezuto, No. 1,660,235; Reach, No. 1,870,750; Farison, No. 2,590,951; Schenk, No. 2,188,114; Quire, No. 3,204,955; Melchiona, No. 3,219,342; Carr, No. 3,614,908; Kane, No. 3,655,185; Taylor, No. 3,747,593 and Yosef, No. 3,785,645.

While the structure disclosed in each of these patents are operable for the intended structure generally represented by these patented devices often include inherent disadvantages. Such disadvantages or problems are primarily directed to the unnecessarily or overly complex structural design of such devices which adds both to their initial cost and/or reliable operability. In addition, such devices should be relatively maintenance free but yet sufficiently designed and structured to provide proper force and/or stress to the intended part of the body.

SUMMARY OF THE INVENTION

This invention relates to an exercise device of the type primarily designed to develop predetermined muscles or portions of the human body through the exerting of stress on the body.

More particularly, the subject exercise device comprises a resistance means in the form of at least one and preferably two resistance elements each made from an elastic material. This elastic material is attached to handle means of the device. The handle means includes at least two handle elements disposed in spaced relation to one another and in interconnecting relation on the resistance means.

Resistance connector means is formed on each of the handle elements and is specifically disposed and configured to engage at least one and, depending on the particular embodiment, preferably both of the resistance elements.

One embodiment of the present invention comprises a single resistance element having an endless, continuous configuration interconnected to both of the spaced apart handle elements. In this embodiment, the resistance connector means includes internal, elongated passages formed on the interior and passing entirely through each of the handle elements. These passages are preferably formed in a straight line, linear configuration and further being coaxially disposed relative to the central, vertical axis of each of the handle elements.

Yet another embodiment of the present invention comprises two resistance elements of substantially the same size each made of elastic material and comprising an endless, substantially continuous configuration. Each of these elements are connected to separate handle elements by means of resistance connector means which, in this embodiment, also are defined by longitudinal, linear passages formed on the interior of each of the handle elements and extending along the length thereof. Attachment means in the form of a single, rigid ring element is disposed in interconnected relation to each of the resistance elements. The disposition of this attachment ring is such as to be substantially spaced from each of the handle elements and movably interconnecting substantially corresponding portions of the resistance elements.

Yet another embodiment of the present invention comprises a plurality of resistance elements having a substantially linear configuration and opposite end portions. Each of the end portions are specifically configured to be secured within a resistance connector means in the form of a socket. A socket is formed in opposite ends of each handle element and is specifically adapted to receive the end portion of each of the resistance elements such that the handle elements are maintained in spaced apart relation to one another. Along these lines the resistance elements are disposed in spaced, substantially parallel relation to one another when tension is placed on the respective handle elements. This specific cross-sectional configuration of the end portions of each resistance element may vary but preferably this cross-sectional configuration corresponds to the cross-sectional configuration of the socket in the opposite ends of each of the handle elements.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is essentially a schematic representation of one embodiment of the exercise device in operative form.

FIG. 2 is an end view showing handle elements attached to the resistance means of the present invention.

FIG. 3 is a front view of the embodiment shown in FIG. 1.

FIG. 4 is a sectional view taken along line 4—4 of FIG. 3.

FIG. 5 is an end view of yet another embodiment of the present invention.

FIG. 6 is a front view of the embodiment shown in FIG. 5 in partial section.

FIG. 7 is an end view of yet another embodiment of the present invention.

FIG. 8 is a front view in partial section of the embodiment represented in FIG. 7.

FIG. 9 is a sectional view taken along line 9—9 of FIG. 8 showing the interior of the handle element and means of attachment of a resistance element thereto.

Similar reference characters refer to similar parts throughout the several views of the drawings.

DETAILED DESCRIPTION

As shown in FIG. 1 the subject invention is directed to an exercise device generally indicated as 10 designed to be manipulated by a human for the express purpose of developing certain portions of the body and more particularly certain muscles in the body. While not limited exclusively to this use, the subject exercise device is primarily designed for the development of the pectoral muscles or the breast area of the user.

The structure of the invention comprises, in one embodiment, (FIGS. 1 and 3) a resistance means including at least one resistance element 12 disposed in interconnecting relationship between handle means including two handle elements 14. In the embodiment discussed, the resistance element 12 has a continuous, endless configuration and is interconnected to the handle elements 14 by resistance connector means.

Referring to FIGS. 3 and 4 the resistance connector means of the present invention includes linear, elongated passages 16 formed on the interior of each of the handle elements 14 and disposed in coaxial relation with the longitudinal axis of each of the handle elements 14. With reference to FIG. 4 the cross-sectional configuration of the passage 16 substantially corresponds to the cross-section of the resistance element 12. By virtue of this structural arrangement the resistance element 12 can freely pass through the two handle elements 14 or alternately, depending upon the relative dimensions of the cross-section of the resistance element 12 and the passage 16, can be firmly attached or positioned on the handle means as indicated.

In operation (FIG. 1) the user grabs the opposite handle elements 14 with the hands 15. Upon pulling of the handle elements 14 away from one another, as indicated, the elastic material from which the resistance element 12 is formed causes a biasing force to be exerted on the handle elements and accordingly on the arms and/or body of the user. Proper manipulation of the device causes development of predetermined portions of the user's body, and in this case the breast region.

With reference to the embodiment of FIG. 6 the resistance means comprises a plurality of resistance elements 13 interconnected to the handle elements 14 by passage through the individual passages 16 comprising the resistance connector means as set forth with reference to the description of the embodiment of FIG. 3. Each of the resistance elements 13 are also formed from an elastic material and accordingly provide the proper biasing force on the handle elements 14 when these handle elements are forced apart as indicated by operation of the embodiment shown in FIG. 1. An attachment means or connecting means comprises a rigid ring 18 interconnected to each of the resistance elements 13 by these elements passing therethrough. The ring may be preferably made of a rigid material so as to resist separation of the resistance elements 13 from one another and thereby add to the biasing force exerted on the body of the user when the handle elements are attempted to be separated. Alternately, however, the attachment ring 18 may be made of a relatively flexible rather than purely rigid material which still presents proper biasing force upon attempted separation of the handle elements as shown in FIG. 1.

Yet another embodiment of the present invention comprises a plurality of resistance elements 17 also made of a flexible, elastic material and essentially defining an elongated, linear configuration when disposed in the orientation shown in FIG. 8. Each of the resistance elements 17 include specifically configured end portions 20 which are attached to the handle means 14 by the resistance connector means. In this embodiment the resistance connector means comprises at least one socket 22 formed in the interior and adjacent each of the oppositely disposed ends of the handle elements 14. The respective dimensions of the socket means 22 and the end portions 20 may be such as to form a secure, friction fit therebetween in order to insure that the elements 17 will not be dislodged from the respective handle elements 14.

As is true with the embodiments of FIGS. 3 and 6, the resistance elements 17 are formed from an elastic, flexible material and accordingly attempted separation of the handle elements 14 by the user, as generally shown in FIG. 1, will cause a biasing force to be exerted on the certain muscles of the body affected by the separation of the handle element. Repeated usage of these muscles causes their development as is readily accepted and known in the body development field. With reference to FIG. 9 the cross-sectional configuration of the end portion 20 and the socket portion 22 is such as to cause a firm mating engagement. This cross-sectional configuration may be rectangular as shown or may be a number of other obvious configurations which will satisfy the operability of firmly attaching the resistance elements 17 to the handle elements 14.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described, what is claimed is:

1. An exercise device of the type primarily designed to develop predetermined portions of the human body, said exercise device comprising: handle means including at least two handle elements disposed in spaced relation to one another; resistance means disposed in interconnecting relation to said two handle elements; resistance connector means integrally formed on each of said handle elements, said resistance means comprising portions thereof disposed in engaging relation with said resistance connector means, said resistance means including at least two elastic elements and interconnecting means disposed in interconnecting relation to each of said elastic elements, each one of said elastic elements disposed in interconnected biasing relation between said attachment means and each of said handle means, whereby separation of said handle elements from one another causes said elastic elements to exert a force on the handle elements, the interconnecting means, and of the body of the user.

2. An exercise device as in claim 1 wherein said resistance means comprises at least two elastic elements each made of flexible material and including a substantially elongated configuration having two end portions, each end portion integrally attached to said elastic elements and disposed in said resistance connector means of each handle element.

3. An exercise device as in claim 2 wherein said resistance connector means comprises two sockets oppositely disposed to one another and each positioned contiguous an extremity of each said handle element.

4. An exercise device as in claim 1 wherein said resistance connector means comprises a passage extending through the interior of each of said handle elements and disposed to extend along the length thereof, each of said elastic elements extending through the interior of a passage in one of said handle elements.

5. An exercise device as in claim 4 wherein each of said elastic elements comprise a continuous, endless configuration having portions thereof movably disposed in said passage of each of said handle elements.

6. An exercise device as in claim 1 wherein said interconnecting means comprises a ring member, each of said elastic elements being movably disposed within said ring member.

* * * * *